US005327331A

United States Patent [19]

Roberts

[11] Patent Number: 5,327,331

[45] **Date of Patent: * Jul. 5, 1994**

[54] ARISING AID

[76] Inventor: Seth D. Roberts, 3210 Tolman Hall, Department of Psychology, University of California, Berkeley, Calif. 94720

[ * ] Notice: The portion of the term of this patent subsequent to Jan. 7, 2009 has been disclaimed.

[21] Appl. No.: 816,669

[22] Filed: Jan. 3, 1992

Related U.S. Application Data

[63] Continuation of Ser. No. 220,459, Jul. 18, 1988, Pat. No. 5,079,682, which is a continuation-in-part of Ser. No. 82,677, Aug. 7, 1987, abandoned.

[51] Int. Cl.[5] ..... F21V 23/00

[52] U.S. Cl. ..... 362/176; 362/801; 368/256

[58] Field of Search ..... 362/276, 373, 260, 801, 362/1, 2, 295; 128/395; 368/12, 256

[56] References Cited

U.S. PATENT DOCUMENTS

| | | | |
|---|---|---|---|
| 2,444,748 | 7/1948 | Parissi | 368/256 |
| 2,612,599 | 9/1952 | Matson et al. | 362/801 |
| 3,727,395 | 4/1973 | Baylor | 368/256 |
| 3,798,889 | 3/1974 | Chadwick | 368/256 |
| 4,028,882 | 6/1977 | Muncheryan | 58/152 B |
| 4,091,441 | 5/1978 | Ott | 307/141 |
| 4,282,563 | 8/1981 | Ohta et al. | 362/216 |
| 4,379,237 | 4/1983 | Mosteller, Jr. | 315/36 |
| 4,395,661 | 7/1983 | Becker | 315/36 |
| 4,600,723 | 7/1986 | Short et al. | 514/416 |
| 4,608,622 | 8/1986 | Gonser et al. | 362/32 |
| 5,079,682 | 1/1992 | Roberts | 362/276 |

FOREIGN PATENT DOCUMENTS

| | | | |
|---|---|---|---|
| 1965062 | of 1971 | Fed. Rep. of Germany | 368/256 |
| 2412392 | of 1975 | Fed. Rep. of Germany | 368/256 |
| 250290 | of 1985 | Japan | 368/256 |
| 59-10659 | 12/1985 | Japan . | |
| 8400693 | of 1984 | PCT Int'l Appl. . | |
| 2045981 | of 1980 | United Kingdom | 368/256 |

OTHER PUBLICATIONS

Kraehenbuehl, Electrical Illumination (1942), pp. 126–127.

*Designer's Handbook Light Source Applications*, copyright 1980 GTE Products Corporation pp. 10–13.

Aschoff et al., Human Circadian Rhythms in Continuous Darkness: Entrainment by Social Cues. *Science*, 171, 213–215 (1971).

Wever, *The Circadian System of Man* (1979), pp. 144–156, 184–191.

Lewy et al., Light Suppresses Melatonin Secretion in Humans, *Science*, 210, 1267–1269 (1980).

(List continued on next page.)

*Primary Examiner*—Ira S. Lazarus

*Attorney, Agent, or Firm*—Gary Peterson

[57] ABSTRACT

A method of reducing the resistance of a sleeping mammal to arising at a preselected wake up time by exposing the mammal to at least one source of artificial light for a period of exposure of at least about 0.5 hour and no longer than about 8 hours before the preselected wake up time. The intensity of the artificial light may increase during the period of exposure. an apparatus for carrying out the method comprises a normally deacutated source of artificial light capable of illuminating a mammal, comprising a plurality of electric lamps, a control device, such as a timer, for signalling the commencement of a period of exposure preceding the mammal's preselected wake up time and an increase in illumination intensity during the period of exposure, after its commencement. The apparatus further features circuitry and a power supply, responsive to the control device, for actuating one lamp in response to the commencement signal, and for actuating additional lamps later during the period of exposure.

19 Claims, 2 Drawing Sheets

OTHER PUBLICATIONS

Boulos et al., Food Availability and Daily Biological Rhythms, *Neuroscience & Biobehavioral Reviews,* 4, 119-131 (1980).

Czeisler et al., Entrainment of Human Circadian Rhythms by Light-Dark Cycles: a Reassessment, *Photochemistry and Photobiology,* 34, 239-247 (1981).

Czeisler et al., Bright Light Resets the Human Circadian Pacemaker Independent of the Timing of the Sleep/Wake Cycle, *Science,* 233, 667-671 (1986).

Lewy, et al., Antidepressant and Circadian Phase-Shifting Effects of Light, *Science,* 235, 352-354 (1987).

Czeisler et al., Response to Letter, *Science,* 235, 145 (1987).

Winfree, A. T., *The Timing of Biological Clocks* (1987).

Illuminating Engineering Society, *IES Lighting Handbook* (5th ed. 1972), Chapter 8, pp. 8-1 through 8-54.

McGuire et al., Entrainment of the Body Temperature Rhythm in Rats: Effect of Color and Intensity of Environmental Light, *Science,* 181, 956-57 (1973).

Takahashi et al., Spectral Sensitivity of a Novel Photoreceptive System Mediating Entrainment of Mammalian Circadian Rhythms, *Nature,* 308, 186-88 (1984).

Squibb et al., Feeding Behavior of Chicks Under Three Lighting Regimens, *Poultry Science,* 58, 641-45 (1979).

ARISING AID

CROSS-REFERENCE TO RELATED APPLICATION

This is a continuation of U.S. patent application Ser. No. 220,459, filed Jul. 18, 1988, now U.S. Pat. No. 5,079,682, which is a continuation-in-part of U.S. patent application Ser. No. 082,677, filed Aug. 7, 1987, now abandoned, both of which are incorporated by reference.

FIELD OF THE INVENTION

The present invention relates generally to illumination, and more particularly to methods for illuminating mammals and apparatus for carrying out such methods.

SUMMARY OF THE INVENTION

The present invention comprises a method of illuminating a mammal having a preselected wake up time, for the purpose of reducing the resistance of the mammal, while sleeping, to arising at the preselected wake up time. The mammal is exposed to at least one source of artificial light for a period of exposure of at least about 0.5 hour and no longer than about 8 hours before the preselected wake up time.

The invention further comprises an apparatus for illuminating a mammal having a preselected wake up time, comprising a normally deactuated source of artifical light capable of exposing a mammal, comprising a first lamp and a second lamp. The apparatus further comprises a device for signalling the commencement of a period of exposure that precedes the mammal's preselected wake up time, and for signalling at least one increase in illumination intensity during the exposure period, after its commencement. Further comprising the apparatus is circuitry, responsive to the signalling device, for actuating the first lamp in response to the commencement signal, and for actuating the second lamp in response to the increased intensity signal.

DETAILED DESCRIPTION OF THE PREFERRED EMBODIMENTS

Figure 1:
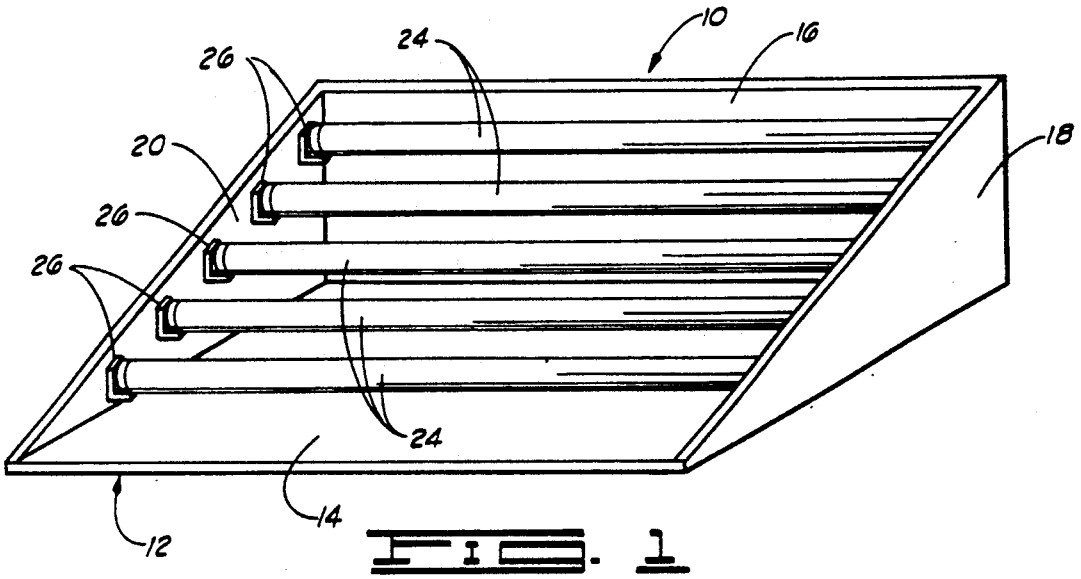
FIG. 1 is a perspective view of the illumination apparatus of the present invention.
Figure 2:
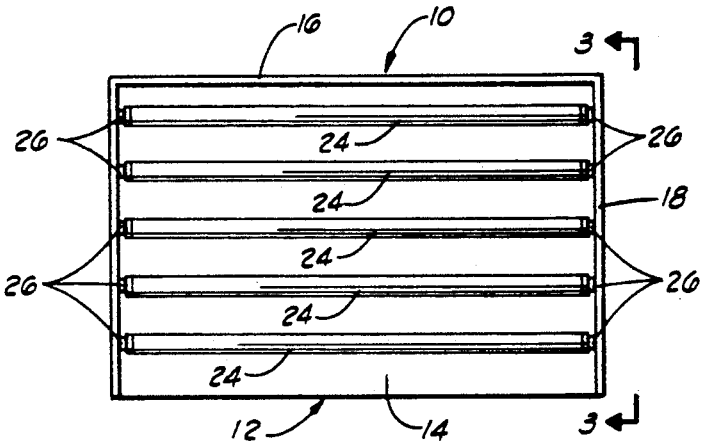
FIG. 2 is a plan view of the illumination apparatus of the present invention.
Figure 3:
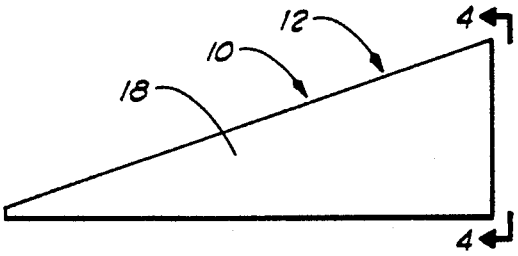
FIG. 3 is a side elevational view of the illumination apparatus of the present invention, taken along line 3—3 of FIG. 2.

The present invention comprises a method of reducing the resistance of a sleeping mammal, and most preferably a human, to arising at a preselected wake up time, and of assisting the sleeping mammal in arising at such preselected wake up time. This reduction of resistance to, and assistance in, awakening is carried out by illuminating the mammal during the period immediately preceding the preselected wake up time, which period will ordinarly coincide with a latter portion of the mammal's sleep period.

In accordance with the method of the present invention, a mammal is exposed to at least one source of artificial light for a period of at least about 0.5 hour and no longer than about 8 hours immediately preceding the mammal's preselected wake up time. More preferably, the period of exposure is between about 1 hour and about 6 hours immediately preceding the preselected wakeup time. A most preferred period of exposure is about 3 hours immediately preceding the preselected wake up time.

In general, a period of exposure should be selected in accordance with the sleeping characteristics of the mammal: if a period of exposure does not cause the mammal to arise early enough, the period of exposure should be lengthened; on the other hand, if a given period of exposure causes the mammal to awaken too early, the period of exposure should be shortened.

The color temperature of the source of artifical light is preferably between about 2000 degrees and 40,000 degrees, Kelvin, and more preferably between 2000 degrees and 10,000 degrees Kelvin, and most preferably between about 3000 degrees and about 9000 degrees Kelvin. A particularly preferred range of color temperatures is between about 6000 degrees and about 8000 degrees Kelvin, which corresponds to the color temperature of the sky. Especially preferred is a color temperature of 7500 degrees Kelvin. Preferably, the color temperature of the artificial light is substantially constant over the period of exposure.

During at least a part of the period of exposure, the intensity of the artificial light preferably increases as the preselected wake up time approaches. Once the maximum intensity level is reached, the intensity of the artificial light preferably remains at this maximum level until the preselected wake up time occurs. During the period of increasing intensity, the intensity may be increased in a series of discrete steps, or more preferably is increased continuously as a function of time.

Preferably, between about 0 hours and about 7 hours should elapse between the onset of the dimmest light and the onset of the brightest light. More preferably, between about 0.5 hours and about 3 hours, and most preferably about 1 hour, should elapse between onset of the dimmest light and onset of the brightest light.

The maximum intensity of the artificial light during the period of exposure preferably is between about 1 lux and about 1000 lux, and more preferably is between about 2 lux and about 200 lux, and most preferably about 40 lux, measured at the head of the mammal. If an intensity gradient is used in accordance with the preferred embodiment of the present invention, the minimum intensity of the artificial light during the period of exposure is between about 0 lux and about 50 lux, and is more preferably between about 0.1 and about 10 lux. A particularly preferred minimum intensity is about 3 lux. These intensities are measured at the head of the mammal.

The artificial light may reach the mammal in any way, such as by direct straight-line exposure, by reflection from a mirror, or by diffuse reflection from structural elements such as walls and ceilings. Diffuse reflection is the most preferred form of illumination, with the source of artificial light not visible to the mammal.

The Figures show an illumination apparatus, generally designated by reference numeral 10, adapted to carry out the method of the present invention. With reference to FIGS. 1 through 4, the apparatus 10 comprises a housing 12, formed from a rectangular base 14, a rectangular baffle 16, and two right-triangular side sections 18 and 20. Preferably the base 14, baffle 16 and side sections 18 and 20 are formed from a strong, sturdy and opaque material, such as sheet metal.

The base 14 and baffle 16 are joined along a common edge to form an L-shaped structure which is enclosed on either side by the triangular side sections 18 and 20. The housing 12 thus comprises a partially enclosed structure, resembling a triangular prism, having one unenclosed face which permits access to the interior of the housing 12 and which provides an outlet for illumination originating within the housing 12.

Positioned within the housing 12 is a normally deactuated source of artificial light. This source preferably comprises at least two, and preferably more than two electric lamps 24, most preferably fluorescent lamps. Each of these lamps preferably is characterized by a color temperature suitable for use in the method of the present invention, and preferably also is characterized by a substantially constant color temperature, independent of the intensity of the light produced by the lamp. Each lamp 24 is installed within an electrically compatible fixture 26 positioned within the housing 12, preferably on the opposed side sections 18 and 20 of the housing 12. Each fixture is operatively connected to a power source (not shown).

Figure 4:
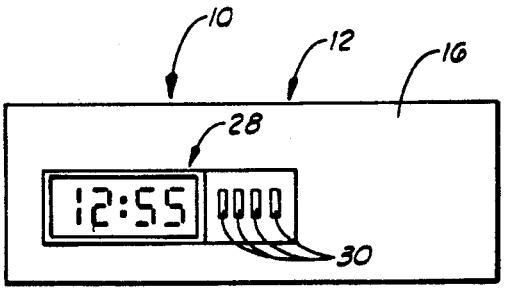
FIG. 4 is a rear elevational view of the illumination apparatus of the present invention, taken along line 4—4 of FIG. 3.

As best shown in FIG. 4, the illumination apparatus 10 further comprises a control device, such as a timer 28, having timer controls 30. The timer 28 preferably is installed in the frame 12 in such a way as to permit access to the timer controls 30 by the user of the illumination apparatus 10. In the embodiment shown in the Figures, the timer 28 is installed in the baffle 16 and is powered by a power source (not shown).

The control device functions to signal the commencement of a period of exposure to illumination, and preferably also functions to signal one or more increases in illumination intensity levels during such period. The commencement time for the period of illumination, and preferably the intensity gradient during such period, may be designated by a user via the timer controls 30. Programmable timers capable of performing these control functions are commercially available, and the programming of these timers is within the ability of those of ordinary skill in the timer art. While only a single timer 28 is disclosed in the Figures, the control device may comprise a plurality of timers, each operatively engaged with a different lamp 24.

Electrical circuitry (not shown) interconnects the control device with each lamp 24. In response to a commencement signal from the control device at the commencement of the period of exposure, the circuitry and its associated power supply causes at least one, and preferably only one, of the normally deactuated lamps 24 to illuminate. As the preselected wake up time approaches, an increased intensity signal from the timer 28 and its associated circuitry causes a second lamp 24 to illuminate, thereby increasing the intensity of the artificial light produced within the housing 12. As additional time elapses, another signal from the timer 28 causes a third lamp 24 to illuminate, and so on in a stepwise manner until the maximum light intensity is attained. The plural lamps, the control device, and the associated circuitry and power supply thus function to increase the intensity of artificial light during the period of exposure, as the preselected wake up time approaches.

Once the maximum light intensity is reached, the illuminated lamps remain illuminated until deactuated, either manually by the user, or in response to another signal from the control device after the preselected wake up time. Electrical circuitry with the capabilities just described is commercially available, and its installation to perform the above-described functions is within the ability of one of ordinary skill in the timer art.

Figure 5:
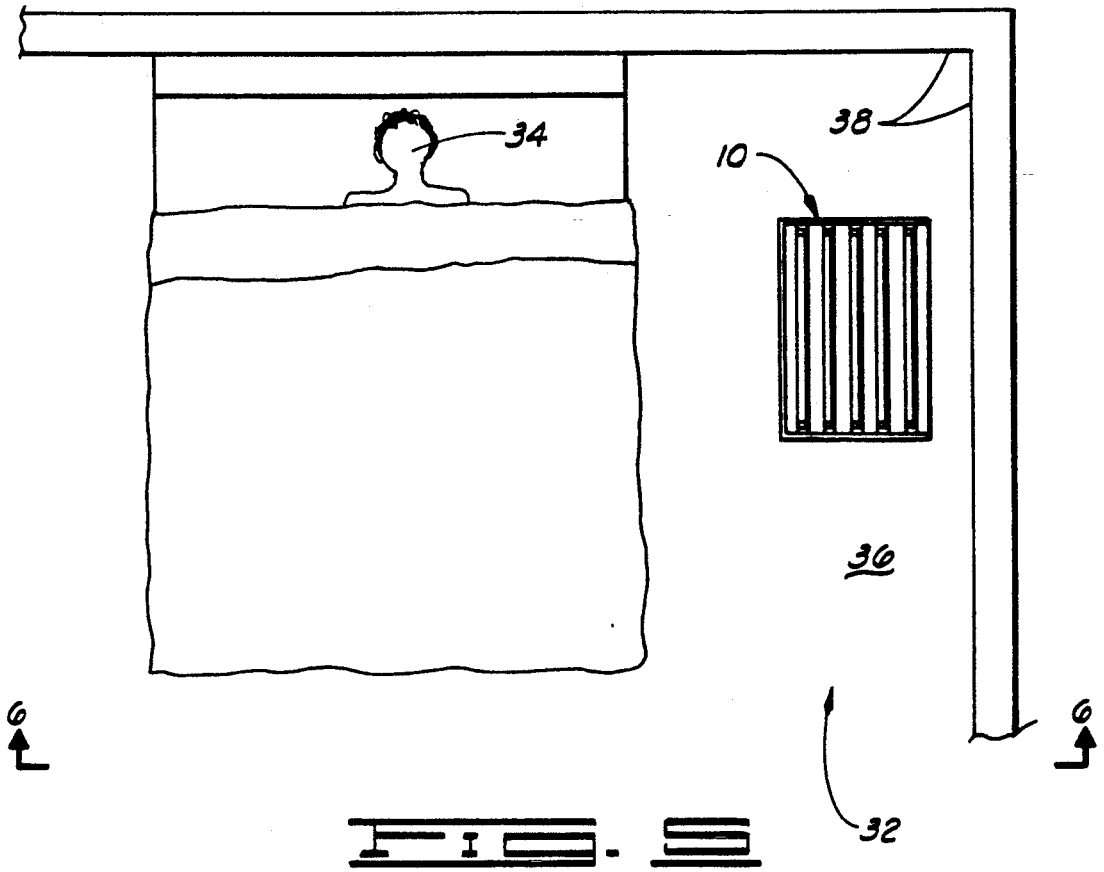
FIG. 5 is a plan view of a portion of a room in which the illumination apparatus and method of the present invention are in use, showing the illumination apparatus and a sleeping user of the method.
Figure 6:
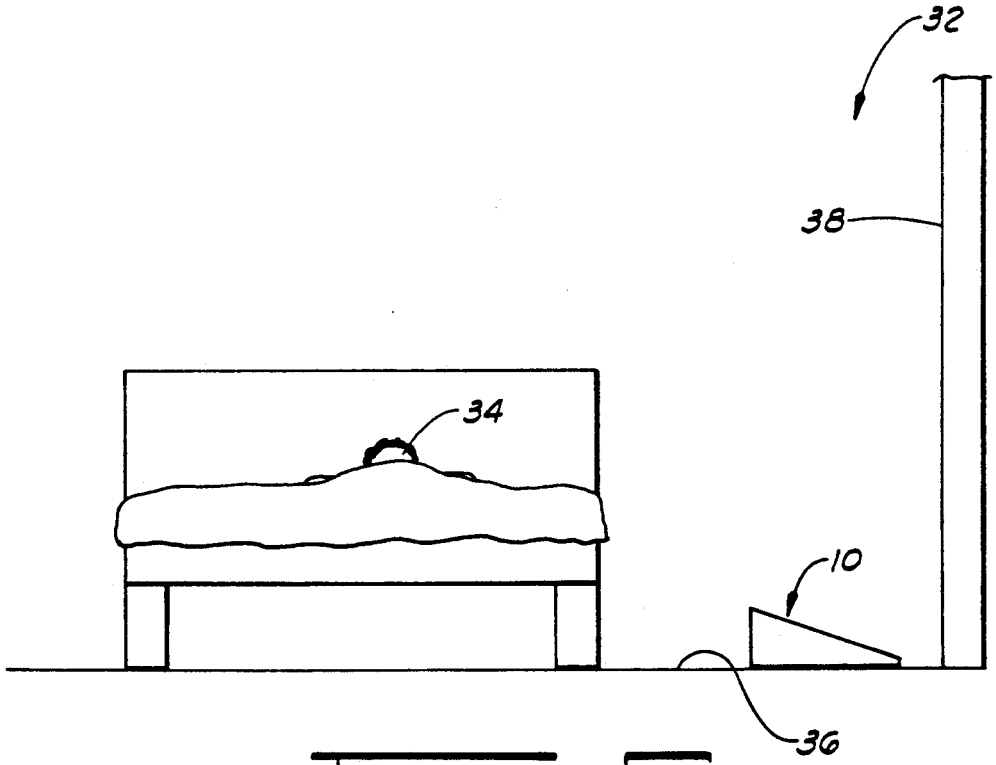
FIG. 6 is an elevational view of the room shown in FIG. 5, taken along line 6—6 of FIG. 5.

The operation of the illumination apparatus 10 is illustrated in FIGS. 5 and 6. The apparatus 10 is positioned within an enclosure such as a room 32, occupied by a mammal, such as a human 34. The illumination apparatus 10 is positioned so that its base 14 rests on a flat surface, such as floor 36, and preferably is oriented so that the lamps 24 are not directly exposed to the mammal. Instead, the lamps 24 illuminate the mammal indirectly, by diffuse reflection from walls 38, the ceiling, or other structural elements of the enclosure. In this regard, it will be noted that the frame 12, and more specifically the opaque baffle 16 and side sections 18 and 20, function to shield the mammal from direct exposure from the source of artificial illumination, as best shown in FIG. 6.

The following examples illustrate the practice of the method and apparatus of the present invention.

EXAMPLE ONE

This Example measured the invention's effect on the difficulty of getting up in the morning. The subject was a 58-year-old woman living at home. About 4 days/-week, she used an alarm clock to get up (usually at 5:20 a.m.); these were days she needed to go to work. On other days, she slept as long as she liked (no alarm clock). The experiment had an ABA design: the device was absent for a few weeks, present for a few weeks, and finally absent for a few weeks. Each morning, the subject rated her difficulty getting up.

The device used in this experiment consisted of one 48" quick-start flourescent fixture with a General Electric Chroma-75 bulb connected to a clock that turned the light on at 3:00 a.m. or 4:00 a.m. and off at 6:00 a.m. The fixture was covered with black paper that blocked all but 2" or 4" of the bulb. The exposed bulb was about 7 feet above the floor and about 10 feet away from the sleeper's head. With 2" exposed, its intensity was 2 lux; with 4" exposed, 5 lux. Light intensities were measured by placing a Gossen Luna-Pro sbc light meter at the position of the sleeper's head and measuring the light intensity in 5 directions: (a) straight up (toward the ceiling) (b) to the right (c) to the left; (d) toward the head of the bed; and (e) toward the foot of the bed. These five measurements are summarized by their median.

The first phase of the Example (No Device 1), without the device, lasted 27 days, with 13 alarm days (days that she used her alarm clock to wake up). The second phase (Device), with the device in operation, lasted 38 days, with 16 alarm days. During the first 7 days of Treatment, 2" of the light were exposed; after that, 4" were exposed. During the first 17 days, the light went on at 3 a.m.; after that, it went on at 4 a.m. The third phase (No Device 2), with the device absent, lasted 18 days, with 11 alarm days.

Each morning the subject rated her difficulty getting up on a 1-to-5 scale where 1=easiest and 5=hardest.

She described a rating of 1 as corresponding to days when "I opened my eyes and felt wide awake," a rating of 3 to days when "I opened my eyes, felt a little more sleepy than I would like, verging on the uncomfortable but not quite," and a rating of 5 to days when getting up was "a real wrench, not physically painful but uncomfortable." She also recorded the time that she turned of the light to go to sleep and the time that she woke up. She wrote down the data on a piece of paper by her bed.

Table 1 gives the mean difficulty ratings for each phase of the experiment. On alarm days, difficulty ratings were significantly lower with the device (mean rating 2.3±s.e. of the mean 0.2, 16 days) than without the device (3.1±0.2, 23 days), t(37)=2.8, p=0.008. (All p values given here are two-tailed.) The difficulty ratings did not differ significantly on non-alarm days, t(42)=0.5, p=6.

TABLE 1

Experiment 1: Mean Difficulty Ratings

| | Type of Day | | | |
|---|---|---|---|---|
| | Alarm | | Non-Alarm | |
| Phase | n | rating | n | rating |
| Baseline 1 | 12 | 3.5 ± .4 | 15 | 1.8 ± .1 |
| Treatment | 16 | 2.3 ± .2 | 22 | 1.8 ± .1 |
| Baseline 2 | 11 | 2.7 ± .2 | 7 | 2.0 ± .3 |

Note: Difficulty was rated on a scale where 1 = least difficult, 5 = most difficult.

EXAMPLE TWO

Example Two involved a 33-year-old man sleeping at home. In contrast to the subject of Example One, this person could get up whenever he felt like it, and he never used an alarm clock. The measure of interest in this experiment was the time of arising. On some days, the subject would wake up in the morning, get up, prepare to go to work, and then fall back asleep. So there were two arising times to consider: the first and (on some days) the second.

Example Two measured the effect of the device; it was present on some days and absent on others. Example 2 also measured the effect of changing the color temperature of the light.

The device in this Example was set up to produce something resembling the increasing intensity of light associated with sunrise. It involved three lights, each controlled by a separate clock. All of the lights were 48" flourescent bulbs. Light 1 was a single bulb covered by cloth so that only 7" of the bulb was exposed. It was turned on at 4:00 a.m. and off at 9:00 a.m. Light 2 was a single bulb fully exposed. It was turned on at 4:30 a.m. and off at 9:00 a.m. Light 3 was two bulbs fully exposed with a reflector fixture pointed at the wall parallel to the foot of the bed. It was turned on at 5:00 a.m. and off at 9:00 a.m. Lights 1 and 2 were placed on the floor at the base of the bed; Light 3 was placed on a chest of drawers a few feet from the base of the bed, about 9 feet from the sleeper's head. All three lights were parallel to the base of the bed.

Two kinds of flourescent bulbs were used: General Electric Chroma-75, with a color temperature of 7500 degrees K.; and General Electric Warm White, with a color temperature of 3000 degrees K. The earliest Chroma-75 lamp produced 2 lux; the first two together, 10 lux; all three, 60 lux. The Warm White lamps were somewhat brighter than the Chroma 75 lamps: the earliest light produced 3 lux; the first two together, 20 lux; all three, 120 lux.

The Example had five phases. Phase 1 (Chroma-75 1) lasted 15 days; during this phase, the device was on; the lamps were Chroma-75. Phase 2 (No Device 1) lasted 28 days; during this phase the device was off. Phase 3 (Chroma-75 2) lasted 40 days; it was the same as Phase 1. Phase 4 (warm white) was the same as Phase 3 except that the lamps were Warm White; it lasted 22 days. Phase 5 (No Device 2) was the same as Phase 2; it lasted 36 days. The subject recorded the time(s) of arising on a piece of paper by the bed. The data from 5 days was lost.

Table 2 gives the mean (±s.e.) times of first and second arising for each phase of the experiment. The device reduced the time of first arising, t(134)=4.3, p<0.0001. With the device present, the mean first arising time was 5.8±0.2 a.m.; with the device absent, 6.8±0.2 a.m. The device also reduced the time of second arising, t(50)=2.6, p=0.01. With the device present, the mean time of second arising was 8.4±0.2 a.m.; with the device absent, 9.2±0.3 a.m.

The device did not reliably change the percentage of days that the subject fell back asleep after getting up: it was 40% (30 days out of 75) during the device-present phases and 36% (22 out of 61) during the device-absent phases, z=0.4, p=0.7.

Changing the color temperature of the bulb from 7500 degrees K. to 3000 degrees K. did not change the results. Results from the Warm-White phase and the Chroma-75 2 phase did not differ significantly—neither in time of first arising (t(60)=0.4, p=0.7), time of second arising (t(23)=0.4, p=0.7), nor in the percentage of days when the subject fell back asleep after waking up (z=0.8, p=0.4).

TABLE 2

Experiment 2: Times of 1st and 2nd Arising

| | 1st Arising | | 2nd Arising | |
|---|---|---|---|---|
| Phase | n | mean ± s.e. | n | mean ± s.e. |
| Chroma-75 1 | 13 | 5.4 ± .3 | 5 | 8.1 ± .3 |
| No Device 1 | 27 | 6.9 ± .2 | 11 | 9.5 ± .2 |
| Chroma-75 2 | 33 | 5.9 ± .2 | 13 | 8.5 ± .3 |
| Warm-White | 22 | 5.8 ± .3 | 7 | 8.3 ± .4 |
| No Device 2 | 34 | 6.8 ± .3 | 11 | 8.9 ± .5 |

Note: Times are expressed in hr — e.g., 5.4 = 5:24 a.m.

EXAMPLE THREE

Early work with the device—consisting of a single light turned on early in the morning—uncovered a problem: although the subject would wake up early, feel like getting up, and actually get up, he would usually fall back asleep after being out of bed for an hour or so. To try to reduce the frequency of such "re-sleep" a number of changes were tried: this Example describes the change that worked. It consisted of adding dim lights that came on earlier than the main light, so that the light intensity increased relatively gradually.

The subject was the subject of Example Two. Three different versions of the device were used during different phases of the experiment. During Phase 1 (No Gradient), a single light was used. It consisted of the same lamp used to provide the maximum intensity (2 40" bulbs, turned on at 5:00 a.m.) in Example Two; in this phase, 20" of the bulbs were exposed, producing about 40 lux. During Phase 2 (Crude Gradient), three lamps were used. They were the same three lamps used in Example Two, but with 7" exposed of Lamp 1, 21" exposed of Lamp 2, and all 48" exposed of Lamp 3.

Four combinations were used: Lamp 1 alone (about 2 lux) for 20 min.; Lamp 2 alone (4 lux) for 20 min.; Lamps 1 and 2 together (6 lux) for 20 min.; and Lamps 1, 2 and 3 together (60 lux) for the rest of the time. Phase 3 (Sun-matched Gradient) used the same combinations (Lamp 1, Lamps 1 and 2, and Lamps 1, 2 and 3), exposures (7" of Lamp 1, all of Lamp 2, all of Lamp 3), and timings (30 min. with Lamp 1 alone, followed by 30 minutes of Lamps 1 and 2, followed by one or more hours of Lamps 1, 2 and 3) as Example Two. As stated earlier, this sequence produced 2, 10 and 60 lux. Phase 1 (No Gradient) lasted 13 days; Phase 2 (Crude Gradient) lasted 13 days; Phase 3 (Sun-matched Gradient) lasted 20 days.

When a gradient was added, the rate of re-sleep decreased dramatically. On the 13 days before the gradient began, the percentage of days with re-sleep was 69% (9/13); during the 2 blocks of 13 days immediately after the gradient was introduced, the percentages were 23% (1st block) and 23% (2nd block). Overall, on the 33 days with the gradient, the percentage of days with re-sleep was 21% (7/33), significantly less than the percentage during the days without the gradient, $z=2.5$, $p=0.01$. The percentage with the crude gradient (Phase 2), 23%, was similar to the percentage with the sun-matched gradient (Phase 3), 20%.

EXAMPLE FOUR

This Example supplements some of the results of Example Two. It measured the effect of a change in the color temperature of the light—from Chroma-75 lamps (color temperature 7500 degrees K.) to Cool-White lamps (color temperature 4150 degrees K.).

The subject and apparatus were the same as Phases 1 and 3 of Example Two. After 20 days with the Chroma-75 bulbs, General Electric Cool-White bulbs were used for 22 days. The Cool-White lamps were somewhat brighter than the Chroma-75 lamps: the earliest light produced 4 lux; the first two lights together produced 20 lux; and all three lights produced 100 lux. Then the Chroma-75 bulbs were used for 15 days.

Table 3 gives the times of first and second arisings. Changing the color temperature had little if any effect on the waking times. In addition, the percentage of days with re-sleep with the Chroma-75 bulbs (26%=9/35) was not reliably different from the Cool-White percentage (44%=8/18), $z=1.1$, $p=0.3$.

TABLE 3

| Experiment 4: Times of 1st and 2nd Arising | | | | |
|---|---|---|---|---|
| | 1st Arising | | 2nd Arising | |
| Phase | n | mean ± s.e. | n | mean ± s.e. |
| Chroma-75 1 | 20 | 5.1 ± .2 | 4 | 9.0 ± .3 |
| Cool-White | 18 | 5.3 ± .2 | 8 | 8.2 ± .3 |
| Chroma-75 2 | 15 | 5.4 ± .3 | 5 | 8.1 ± .4 |

Note: Times are expressed in hr. — e.g., 5.1 = 5:06 a.m.

Changes may be made in the construction, operation and arrangement of the various parts, elements, steps and procedures described herein without departing from the spirit and scope of the invention as defined in the following claims.

What is claimed is:

1. A method of illuminating a mammal having a preselected wake up time, comprising:

exposing the mammal to at least one source of artificial light for a period of exposure of at least about 0.5 hour and no longer than about 8 hours before the preselected wake up time, in which the artificial light increases in intensity as the preselected wake up time approaches, for at least a part of the period of exposure, said artificial light having a color temperature which remains substantially constant.

2. The method of claim 1 in which the period of exposure is between about 1 hour and about 6 hours before the preselected wake up time.

3. The method of claim 1 in which the artificial light is characterized by a color temperature of between about 2000 degrees and about 10,000 degrees Kelvin.

4. The method of claim 3 in which the artificial light is characterized by a color temperature of between about 3000 degrees and about 9000 degrees Kelvin.

5. The method of claim 1 in which elapsed time between lowest and highest intensity of artificial light is between about 0 and about 7 hours.

6. The method of claim 5 in which the elapsed time between lowest and highest intensity of artificial light is between about 0.5 and about 3 hours.

7. The method of claim 1 in which the light intensity increases monotonically as a function of time during the period of exposure.

8. A method of reducing the resistance of a sleeping mammal to awakening at a preselected wake up time, comprising:

exposing the mammal to at least one source of artificial light for a period of exposure of at least about 0.5 hours and no longer than about 8 hours before the preselected wake up time, in which the artificial light increases in intensity as the preselected wake up time approaches, for at least a part of the period of exposure, said artificial light having a color temperature which remains substantially constant.

9. The method of claim 8 in which the period of exposure is between about 1 hour and about 6 hours before the preselected wake up time.

10. The method of claim 8 in which the artificial light is characterized by a color temperature of between about 2000 degrees and about 10,000 degrees Kelvin.

11. The method of claim 10 in which the artificial light is characterized by a color temperature of between about 3000 degrees and about 9000 degrees Kelvin.

12. The method of claim 8 in which elapsed time between lowest and highest intensity of artificial light is between about 0 and about 7 hours.

13. The method of claim 12 in which the elapsed time between lowest and highest intensity of artificial light is between about 0.5 and about 3 hours.

14. The method of claim 8 in which the light intensity increases monotonically as a function of time during the period of exposure.

15. An apparatus for illuminating a mammal having a preselected wake up time, comprising:

a normally deactuated source of artificial light capable of illuminating a mammal;

means for signalling the commencement of a period of exposure that precedes the mammal's preselected wake up time;

means, responsive to the signalling means, for actuating the source of artificial light during the period of exposure;

means for increasing the intensity of the artificial light during the period of exposure, as the preselected wake up time approaches, while maintaining a substantially constant light color temperature.

16. The apparatus of claim 15 in which the source produces artificial light with a color temperature of between about 2000 degrees and 10,000 degrees Kelvin.

17. The apparatus of claim 15 in which the source produces artificial light with a color temperature of between about 3000 degrees and about 9,000 degrees Kelvin.

18. A method of illuminating a mammal having a preselected wake up time, comprising:

exposing the mammal to at least one source of artificial light for a period of exposure of at least about 0.5 hours and no longer than about 8 hours before the preselected wake up time, in which the artificial light increases in intensity as the preselected wake up time approaches, for at least a part of the period of exposure, said artificial light having a color temperature which remains substantially constant, in which the elapsed time between the lowest and highest intensity of artificial light is between about 0.5 and about 3 hours.

19. The method of claim 18 in which the light intensity increases monotonically as a function of time during the period of exposure.

* * * * *

UNITED STATES PATENT AND TRADEMARK OFFICE

CERTIFICATE OF CORRECTION

PATENT NO. : 5,327,331

DATED : July 5, 1994

INVENTOR(S) : Seth D. Roberts

It is certified that error appears in the above-identified patent and that said Letters Patent is hereby corrected as shown below:

Cover page, in the Title: Item [54] and Column 1, line 1, delete "AID and substitute --ASSISTANCE--.

Cover page, in the Abstract:
ln. 7: delete "an" and substitute --An--.
ln. 8: delete "deacutated" and substitute --deactuated--.

col. 1, ln. 1: delete "AID" and substitute --ASSISTANCE--.
col. 1, ln. 30: delete "cal" and substitute --cial-.
col. 2, ln. 2: delete "ordinarly" and substitute -- ordinarily--.
col. 2, ln. 22: delete "artifical" and substitute --artificial--.
col. 4, ln. 42: delete "flourescent" and substitute --fluorescent--.
col. 5, ln. 48: delete "flourescent" and substitute --fluorescent--.
col. 5, ln. 60: delete "flourescent" and substitute --fluorescent--.

Signed and Sealed this

Twenty-ninth Day of November, 1994

Bruce Lehman

*Attest:*

BRUCE LEHMAN

*Attesting Officer*

*Commissioner of Patents and Trademarks*